US010400643B2

(12) United States Patent
Kashiwabara et al.

(10) Patent No.: US 10,400,643 B2
(45) Date of Patent: Sep. 3, 2019

(54) CAM JOURNAL LUBRICANT SUPPLY MECHANISM FOR ENGINE

(71) Applicant: MAZDA MOTOR CORPORATION, Hiroshima (JP)

(72) Inventors: Takashi Kashiwabara, Hiroshima (JP); Tsuyoshi Yamamoto, Hiroshima (JP); Yasushi Nakahara, Higashi-Hiroshima (JP); Kouichi Shimizu, Higashi-Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 34 days.

(21) Appl. No.: 15/756,853

(22) PCT Filed: Mar. 14, 2017

(86) PCT No.: PCT/JP2017/010263
§ 371 (c)(1),
(2) Date: Mar. 1, 2018

(87) PCT Pub. No.: WO2017/169750
PCT Pub. Date: Oct. 5, 2017

(65) Prior Publication Data

US 2018/0274407 A1 Sep. 27, 2018

(30) Foreign Application Priority Data

Mar. 30, 2016 (JP) ..... 2016-069673

(51) Int. Cl.
*F01M 9/10* (2006.01)
*F01M 1/06* (2006.01)
(Continued)

(52) U.S. Cl.
CPC ..... *F01M 9/102* (2013.01); *F01L 1/047* (2013.01); *F01L 13/0036* (2013.01); *F01M 1/06* (2013.01);
(Continued)

(58) Field of Classification Search
CPC ..... F01M 9/102; F01M 9/105; F01M 9/10; F01M 1/06; F01L 2810/02
See application file for complete search history.

(56) References Cited

U.S. PATENT DOCUMENTS 3,958,541 A * 5/1976 Lachnit ..... F01M 9/102 123/90.34
4,729,349 A 3/1988 Sonoda et al.
(Continued)

FOREIGN PATENT DOCUMENTS

DE 43 14 183 A1 7/1994
EP 3121398 A1 1/2017
(Continued)

OTHER PUBLICATIONS

International Search Report issued in PCT/JP2017/010263; dated May 23, 2017.

*Primary Examiner* — Jorge L Leon, Jr.
*Assistant Examiner* — Wesley G Harris
(74) *Attorney, Agent, or Firm* — Studebaker & Brackett PC

(57) ABSTRACT

An oil supply path passes through members separate from a cylinder head (4) to supply a lubricant to bearings (73, 74) of camshaft journals. The oil supply path includes an oil supply passage (66) for the camshaft above the camshaft (19, 20), a connection passage (64) for the camshaft between the oil supply passage for the camshaft and an internal passage (61, 62) in the cylinder head (4), and branch oil passages (68) for the camshaft journals. Each branch oil
(Continued)

passage branches off from the oil supply passage for the camshaft, and is connected to one of the bearings (73, 74) from above. Each of the branch passages includes a throttle (168) with a smaller cross-sectional flow area than the oil supply passage for the camshaft.

5 Claims, 7 Drawing Sheets

(51) Int. Cl.
*F01M 1/04* (2006.01)
*F01L 13/00* (2006.01)
*F01L 1/047* (2006.01)

(52) U.S. Cl.
CPC ..... *F01M 9/10* (2013.01); *F01M 9/105* (2013.01); *F01L 2013/0052* (2013.01); *F01L 2810/02* (2013.01)

(56) References Cited

U.S. PATENT DOCUMENTS

| | | | | |
|---|---|---|---|---|
| 6,962,134 | B1 * | 11/2005 | Douse | F01L 1/18 123/195 A |
| 7,819,096 | B2 * | 10/2010 | McConville | F01L 1/267 123/90.12 |
| 2002/0124819 | A1 * | 9/2002 | Lunsford | F01L 1/34 123/90.15 |
| 2003/0140886 | A1 * | 7/2003 | Hada | F01L 1/024 123/195 A |
| 2011/0220049 | A1 | 9/2011 | Staley et al. | |
| 2013/0228235 | A1 * | 9/2013 | Joshi | F01M 9/10 137/351 |

FOREIGN PATENT DOCUMENTS

| | | | | | |
|---|---|---|---|---|---|
| GB | 2378484 | A | * | 2/2003 | F01L 1/047 |
| JP | S63-123710 | U | | 8/1988 | |
| JP | 03286109 | A | * | 12/1991 | F01M 9/10 |
| JP | H04-022702 | A | | 1/1992 | |
| JP | H04-113717 | U | | 10/1992 | |
| JP | H05-209507 | A | | 8/1993 | |
| JP | H10-148113 | A | | 6/1998 | |
| JP | 2010-164009 | A | | 7/2010 | |
| JP | 2015-028328 | A | | 2/2015 | |
| JP | 2015-169120 | A | | 9/2015 | |
| WO | WO-2009013588 | A2 | * | 1/2009 | F01L 1/022 |

* cited by examiner

CAM JOURNAL LUBRICANT SUPPLY MECHANISM FOR ENGINE

TECHNICAL FIELD

The present invention relates to a lubricant supply mechanism for camshaft journals of an engine.

BACKGROUND ART

Known mechanisms for supplying lubricant to bearings of camshaft journals have been provided for an engine including a camshaft and the bearings. The camshaft is provided in a cylinder head and includes camshaft journals. Each of the bearings rotatably supports one of the camshaft journals of the camshaft.

Patent Document 1 discloses a lubricant supply mechanism for camshaft journals. The mechanism includes oil passages for the camshaft journals, which extend upward from an oil gallery in a cylinder head, and are connected to lower portions of bearings of the camshaft journals. The mechanism supplies the lubricant through the oil passages for the camshaft journals to the bearings from below.

Patent Document 2 discloses a lubricant supply mechanism for camshaft journals, which includes first to third oil passages. The first oil passage guides the lubricant from a hydraulic power source to one of bearings of the camshaft journals. The second oil passage penetrates one of the camshaft journals of a camshaft, which rotates and slides with respect to the bearing connected to the first oil passage, and receives the lubricant intermittently in accordance with the rotation of the camshaft. The third oil passage is located above the camshaft journals, and supplies the lubricant, which has been supplied from the second oil passage, from a position above the camshaft to a bearing of another camshaft journal.

CITATION LIST

Patent Documents

PATENT DOCUMENT 1: Japanese Unexamined Patent Publication No. 2010-164009

PATENT DOCUMENT 2: Japanese Unexamined Patent Publication No. 2015-169120

SUMMARY

Technical Problem

Cylinder heads include not only camshafts but also various types of devices such as fuel injectors and ignition plugs. For example, if precise combustion control is required to increase the thermal efficiency of an engine, the number of ignition plugs is often increased. Additional devices often need to be provided in this manner.

If a cylinder head includes additional devices to meet the demand, the devices need to be arranged away from oil supply passages and a water jacket in the cylinder head.

As in the mechanism described in Patent Document 1, in which the lubricant is supplied to the bearings from below, the cylinder head needs to include oil passages connected to the bearings. These oil passages take up the space available for the devices in the cylinder head and thus render the formation of additional devices difficult.

On the other hand, as in the mechanism described in Patent Document 2, if the lubricant is supplied to the bearings from a position above the camshaft journals, a decreasing number of oil passages are needed in the cylinder head. The additional devices are thus provided relatively easily.

However, as in the mechanism described in Patent Document 2, in which the lubricant is supplied to the bearings from the position above the camshaft journals, the lubricant needs to flow up to the position above the camshaft journals. Thus, the lubricant may be supplied to one(s) of the bearings located farther from the second oil passage at a lower flow rate (pressure) than to the other one(s) of the bearings located closer to the second oil passage. That is, the lubricant may be supplied to the bearings at various pressures.

In the mechanism described in Patent Document 2, the first oil passage needs to be provided in a position in the cylinder head corresponding to the camshaft journal, which includes the second oil passage. If the number of additional devices increases, the first oil passage is difficult to form.

The present invention was made in view of this problem. It is an objective of the present invention to provide a lubricant supply mechanism for camshaft journals of an engine, while accepting devices added to a cylinder head and reducing the variations in the pressures of the oil supplied to bearings of camshaft journals.

Solution to the Problem

In order to achieve the objective, the present invention provides a lubricant supply mechanism for camshaft journals of an engine including a camshaft, provided in a cylinder head and including the camshaft journals, and bearings, each rotatably supporting one of the camshaft journals of the camshaft. The mechanism includes an oil supply path passing through members separate from and attached to the cylinder head to supply a lubricant discharged from an oil pump in the engine to the bearings. The oil supply path includes an oil supply passage for the camshaft located above the camshaft and extending along an axis of the camshaft, a connection passage for the camshaft located between the oil supply passage for the camshaft and an internal passage in the cylinder head, and supplying the lubricant having passed through the internal passage to the oil supply passage for the camshaft, and branch oil passages for the camshaft journals, each branching off from the oil supply passage for the camshaft, connected to one of the bearings from above, and supplying the lubricant to one of the bearings. Each of the branch passages includes a throttle with a smaller cross-sectional flow area than the oil supply passage for the camshaft.

In this configuration, the oil supply passage for the camshaft, the connection passage for the camshaft and the branch oil passages for the camshaft journals pass through the members separate from and attached to the cylinder head. There is thus no need to form oil supply passages connected to the bearings of the camshaft journals inside the cylinder head. Thus, even a larger number of devices can be added to the cylinder head relatively easily.

In addition, each of the branch passages includes a throttle with the smaller cross-sectional flow area than the oil supply passage for the camshaft. Lubricant hardly flows from the oil supply passage for the camshaft to the branch oil passages for the camshaft journals. Unless the pressure of oil in a region of the oil supply passage located upstream of the throttle, is high enough to allow the lubricant to pass through the throttle, no lubricant is supplied to the bearings of the camshaft journals via the branch passages for the camshaft journals. The throttle has a cross-sectional flow area large enough to supply the lubricant to the bearings of the camshaft journals, after the lubricant has filled the region of the oil supply passage located upstream of the throttle (particularly, the oil supply passage for the camshaft). Then, when the lubricant fills the inside of the region of the oil passage located upstream of the throttle, and the pressure of oil becomes high enough to allow the lubricant to pass through the throttle, the lubricant is supplied to the bearings of the camshaft journals via the branch passages for the camshaft journals. As a result, variations in the pressure of oil supplied to the bearings for the camshaft journals decreases.

In one preferred embodiment of the lubricant supply mechanism described above, a cam piece is provided at at least one of two portions of the camshaft on two sides of each of the camshaft journals in a direction along the axis of the camshaft. An oil supply passage for the cam piece branches off from a portion of each of the branch oil passages located upstream of its downstream end and downstream of the throttle and extends along the axis of the camshaft toward the cam piece provided at at least one of two portions of the camshaft on two sides of the camshaft journal corresponding to the branch oil passage in the direction along the axis of the camshaft to supply the lubricant to the cam piece.

That is, the oil supply passage for supplying the lubricant to the cam piece provided at at least one of two portions of the camshaft on two sides of each of the camshaft journals in the direction along the axis of the camshaft branches off from each branch oil passage. With this configuration, the lubricant can be supplied to the cam piece from a position closer to the cam piece. This allows the lubricant to be supplied to the cam piece at a relatively low pressure. In addition, the oil supply passage for the cam piece has a relatively short length. This leads to simplification of the configuration of the oil supply passage.

In one preferred embodiment of the lubricant supply mechanism described above, the camshaft further includes, at or near its axial end, a position regulating journal with a larger diameter than the camshaft journals to regulate an axial movement of the camshaft. A branch passage for the position regulating journal branches off from the connection passage for the camshaft to supply the lubricant to a bearing of the position regulating journal rotatably supporting the position regulating journal. The branch passage for the position regulating journal branches off from the connection passage for the camshaft so as to be located in a position lower than an uppermost portion of the camshaft.

That is, similar to the branch oil passages for the camshaft journals, the branch oil passage for the position regulating journal branches off from the oil supply passage for the camshaft, and is connected to the bearing of the position regulating journal from above to supply the lubricant to the bearing of the position regulating journal. Since the position regulating journal regulating the axial movement of the camshaft has a larger diameter than the camshaft journals, the oil supply passage for the camshaft needs to be located high enough to meet the diameter of the position regulating journal. This increases the vertical size of the engine as a whole.

To address this problem, the branch passage for the position regulating journal branches off from the connection passage for the camshaft so as to be located below an uppermost portion of the camshaft. This enables supply of the lubricant to the bearing of the position regulating journal without any branch passage for the branch oil passage for the position regulating journal in the cylinder head. This reduces an increase in the vertical size of the engine as a whole.

As described above, if the oil supply passage includes the branch oil passage for the position regulating journal, the branch passage for the position regulating journal branches off from a joint between the connection passage for the camshaft and the internal passage in one preferred embodiment.

That is, if the branch oil passage for the position regulating journal branches off from the joint between the connection passage for the camshaft and the internal passage, the branch oil passage for the position regulating journal needs to have a shorter length, which leads to downsizing of the oil supply path as a whole.

Advantages of the Invention

As described above, in the lubricant supply mechanism according to the present invention, there is no need to form oil supply passages connected to the bearings of the camshaft journals inside the cylinder head. Thus, even a larger number of devices can be added to the cylinder head relatively easily. In addition, each of the branch passages for the camshaft journals includes the throttle with a smaller cross-sectional flow area than the oil supply passages for the camshafts. This reduces variations in the pressure of oil supplied to the bearings for the camshaft journals.

DESCRIPTION OF EMBODIMENTS

Exemplary embodiments will now be described in detail with reference to the drawings.

Figure 1:
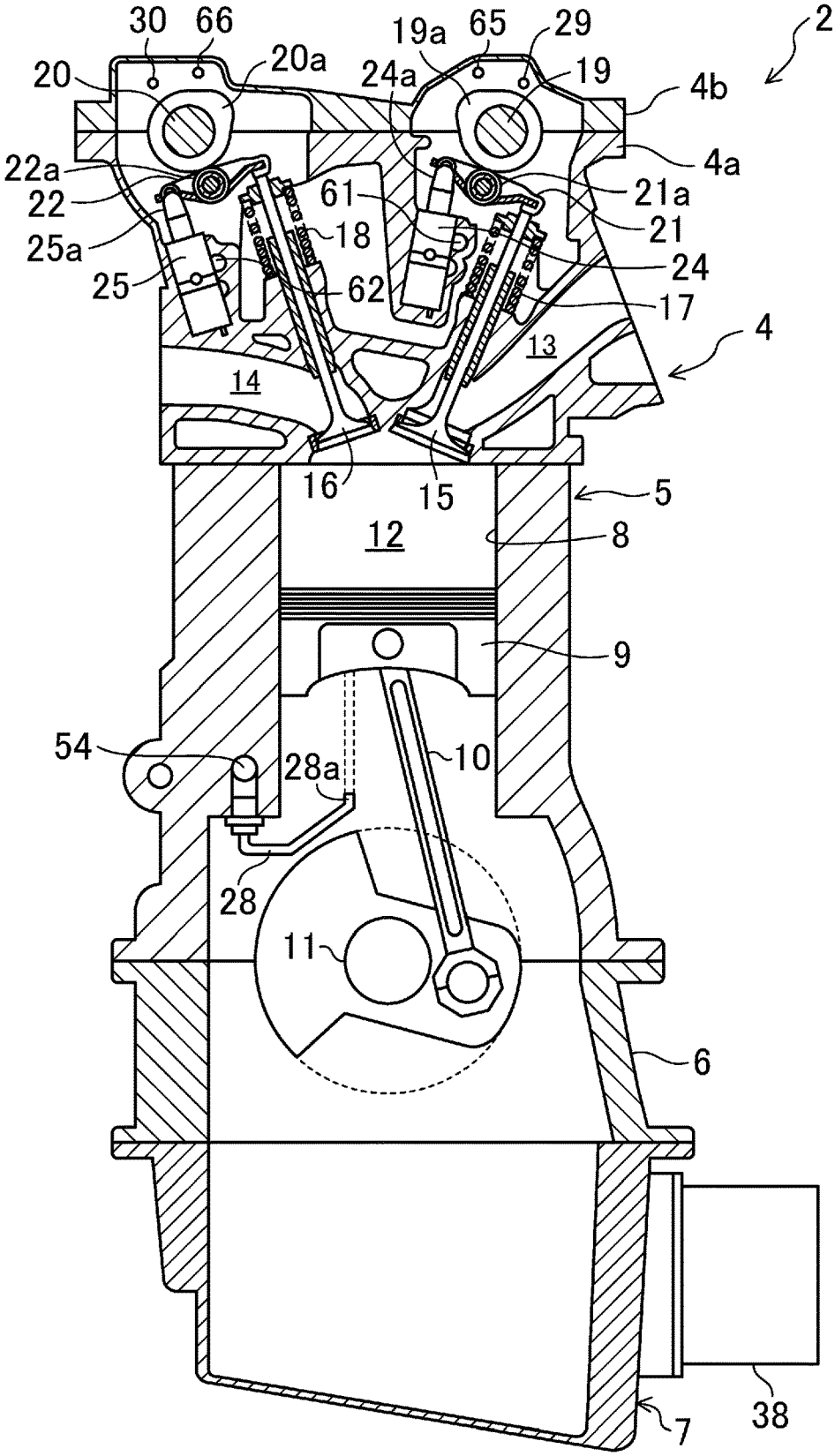
FIG. 1 is a cross-sectional view illustrating a schematic configuration of an engine including a lubricant supply mechanism for camshaft journals according to an exemplary embodiment.

FIG. 1 illustrates a schematic configuration of an engine 2 including a lubricant supply mechanism for camshaft journals according to an exemplary embodiment. This engine 2 is an in-line four cylinder gasoline engine, in which four cylinders 8 are arranged in series in a direction vertical to the paper of FIG. 1, and mounted in a vehicle such as a motor vehicle. In the engine 2, a cylinder head 4, a cylinder block 5, a crankcase 6, and an oil pan 7 are vertically connected to each other. The cylinder block 5 includes the four cylinders 8. Pistons 9, each of which is slidable on the inner peripheral surface of one of the cylinders 8, is connected to a crankshaft 11, which is rotatably supported by the crankcase 6, by a connecting rod 10. Each cylinder 8 of the cylinder block 5, the associated piston 9 and the cylinder head 4 define a combustion chamber 12 for the cylinder 8.

The cylinder head 4 includes a cylinder head body 4*a* and a cover 4*b*, which is a member separate from the cylinder head 4. The cover 4*b* covers the top of the cylinder head body 4*a*.

The cylinder head body 4*a* includes intake ports 13 and exhaust ports 14, which are open to the combustion chambers 12. Each cylinder 8 includes two of the intake ports 13 and two of the exhaust ports 14 (only one each is shown in FIG. 1). Each intake port 13 includes an intake valve 15, which opens and closes the intake port 13. Each exhaust port 14 includes an exhaust valve 16, which opens and closes the exhaust port 14. These intake and exhaust valves 15 and 16 are opened and closed by cam pieces 19*a* and 20*a* provided on the outer peripheries of a rotating intake camshaft 19 and a rotating exhaust camshaft 20, respectively.

Specifically, the intake and exhaust valves 15 and 16 are biased by valve springs 17 and 18, respectively, in a closing direction (upward in FIG. 1). Swing arms 21 and 22 are provided between the intake and exhaust valves 13 and 14 and the cam pieces 19*a* and 20*a*, respectively. One end portions of the swing arms 21 and 22 are supported at the apexes of pivot mechanisms 24*a* and 25*a* of hydraulic lash adjusters (hereinafter referred to as HLAs) 24 and 25, respectively. The swing arms 21 and 22 includes rotatable cam followers 21*a* and 22*a* in their substantial centers, which are pushed downward by the apexes of the cam pieces 19*a* and 20*a* so that the swing arms 21 and 22 swing about the apexes of the pivot mechanisms 24*a* and 25*a* of the HLAs 24 and 25, respectively. The swing arms 21 and 22 swing in this manner so that the other end portions move the intake and exhaust valves 15 and 16 in an opening direction (downward in FIG. 1) against the bias forces of the valve springs 17 and 18, respectively. The HLAs 24 and 25 automatically adjust the clearances of the valves to be zero utilizing the pressure of oil. The HLAs 24 and 25 for one(s) of the four cylinders 8 may include a valve halting mechanism which prevents the intake or exhaust valve 15 or 16 from moving, even when the swing arms 21 or 22 swings.

The cylinder head 4 includes bearings 73 (four in this exemplary embodiment, see FIGS. 2 and 3) of intake camshaft journals and bearings 74 (four in this exemplary embodiment, see FIGS. 2, 3 and 6) of exhaust camshaft journals. At the upper part of the cylinder head body 4*a*, four head bearings 73*a* and four head bearings 74*a* are integrally formed with the cylinder head body 4*a*. Each head bearing 73*a* is the lower half of one of the four 73 (see FIG. 2). Each head bearing 74*a* is the lower half of one of the four bearings 74. The upper half of each bearing 74 is a bearing 74*b* formed in each of cam caps 101, as will be described later. The upper half of each bearing 73 is a bearing formed in each of cam caps (not shown). The head bearings 73*a* and 74*a* may be members separate from the cylinder head body 4*a*.

Figure 3:
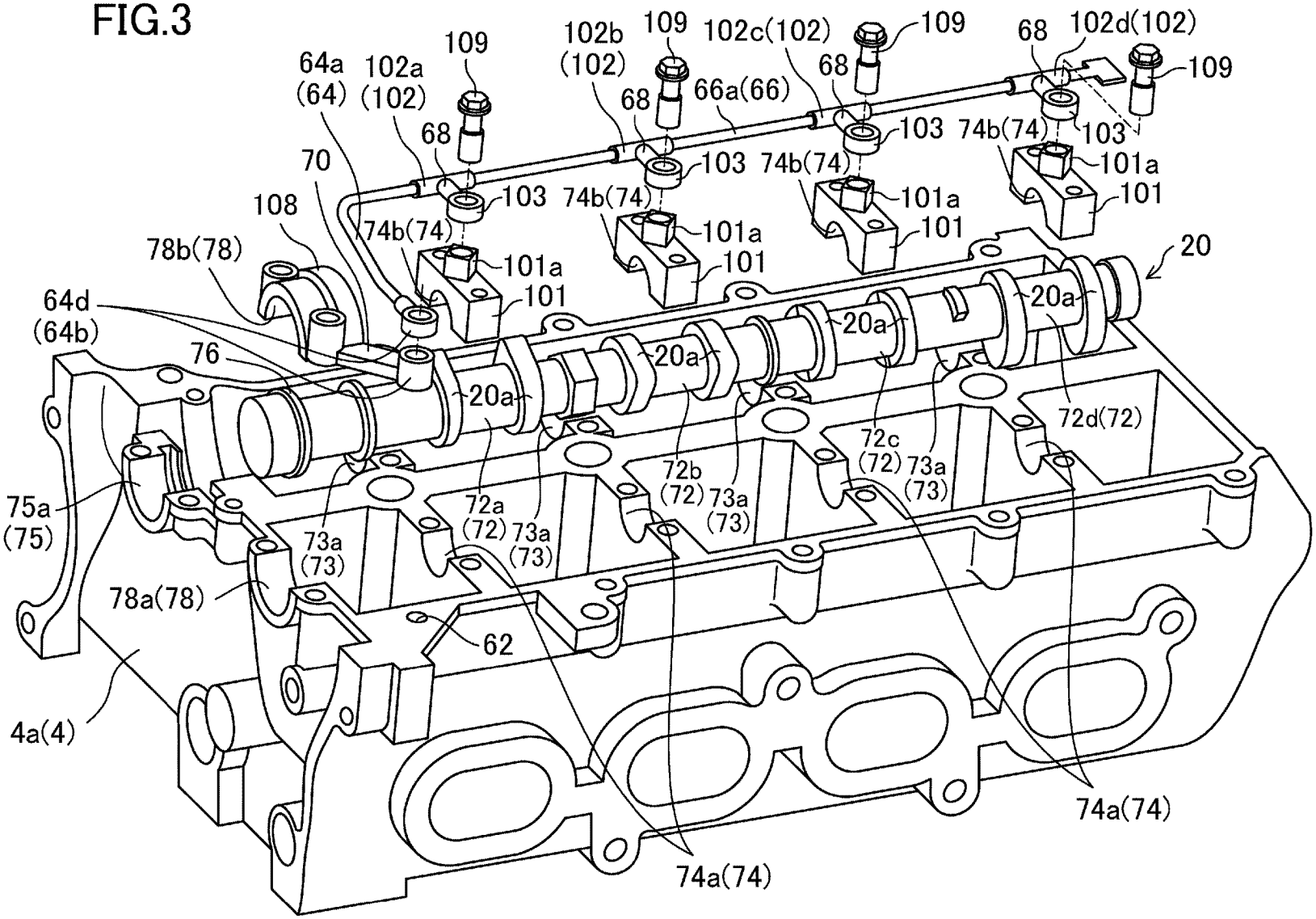
FIG. 3 is an exploded perspective view of a section of a cylinder head of the engine around a camshaft.

The intake camshaft 19 is pivotally supported by the bearings 73 at four camshaft journals provided in the intake camshaft 19. In FIG. 3, only camshaft journals 72 of the exhaust camshaft 20 are shown and the camshaft journals of the intake camshaft 19 are not shown. The exhaust camshaft 20 is pivotally supported by the bearings 74 at four camshaft journals 72 provided in the exhaust camshaft 20.

A main gallery 54 extends along a cylinder bank in the exhaust-side sidewalls of the cylinders 8 of the cylinder block 5. Oil jets 28 for cooling the pistons are provided near the bottom of the main gallery 54 and communicate with the main gallery 54. Each oil jet 28 is provided for one of the pistons 9 (i.e., one of the cylinders 8). Each oil jet 28 includes a nozzle 28*a* under the associated one of the pistons 9. The nozzle 28*a* injects engine oil (hereinafter simply referred to as "oil") toward the back surface of the top of the piston 9.

Near the HLAs 24 inside the cylinder head 4, an internal intake passage 61 extends along the cylinder bank. Near the HLAs 25 inside the cylinder head 4, an internal exhaust passage 62 extends along the cylinder bank. The intake and internal exhaust passages 61 and 62 correspond to the internal passages formed inside the cylinder head 4. The intake and internal exhaust passages 61 and 62 function to supply oil to the HLAs 24 and 25, respectively, and to circulate the oil to oil supply passages 67 and 68 for the intake and exhaust camshafts, which will be described later.

Above the intake camshaft 19 and below the cover 4*b*, an oil supply passage 65 for the intake camshaft extends along the axis of the intake camshaft 19. Above the exhaust camshaft 20 and below the cover 4*b*, an oil supply passage 66 for the exhaust camshaft extends along the axis of the exhaust camshaft 20. Although will be described later in detail, the oil supply passage 65 is a part of an oil supply path for supplying oil as a lubricant to the bearings 73, which rotatably support the camshaft journals of the intake camshaft 19. The oil supply passage 66 is a part of an oil supply path for supplying oil as a lubricant to the bearings 74 (see FIG. 2), which rotatably support the camshaft journals 72 of the exhaust camshaft 2.

Intake oil shower passages 29 are provided above the intake camshaft 19 (and below the cover 4*b*). Exhaust oil shower passages 30 are provided above the exhaust camshaft 20 (and below the cover 4*b*). The intake oil shower passages 29 correspond to "oil supply passages for cam pieces," which supply oil as a lubricant to the cam pieces 19*a* of the intake camshaft 19. The exhaust oil shower passages 30 correspond to "oil supply passages for cam pieces," which supply oil as a lubricant to the cam pieces 20*a* of the exhaust camshaft 20. The intake and exhaust oil shower passages 29 and 30 drop the oil from their downstream ends down to the cam pieces 19*a* and 20*a* under the intake and exhaust oil shower passages 29 and 30, and the contact portions between the swing arms 21 and 22 and the cam followers 21*a* and 22*a* under the cam pieces 19*a* and 20*a*, respectively.

Figure 2:
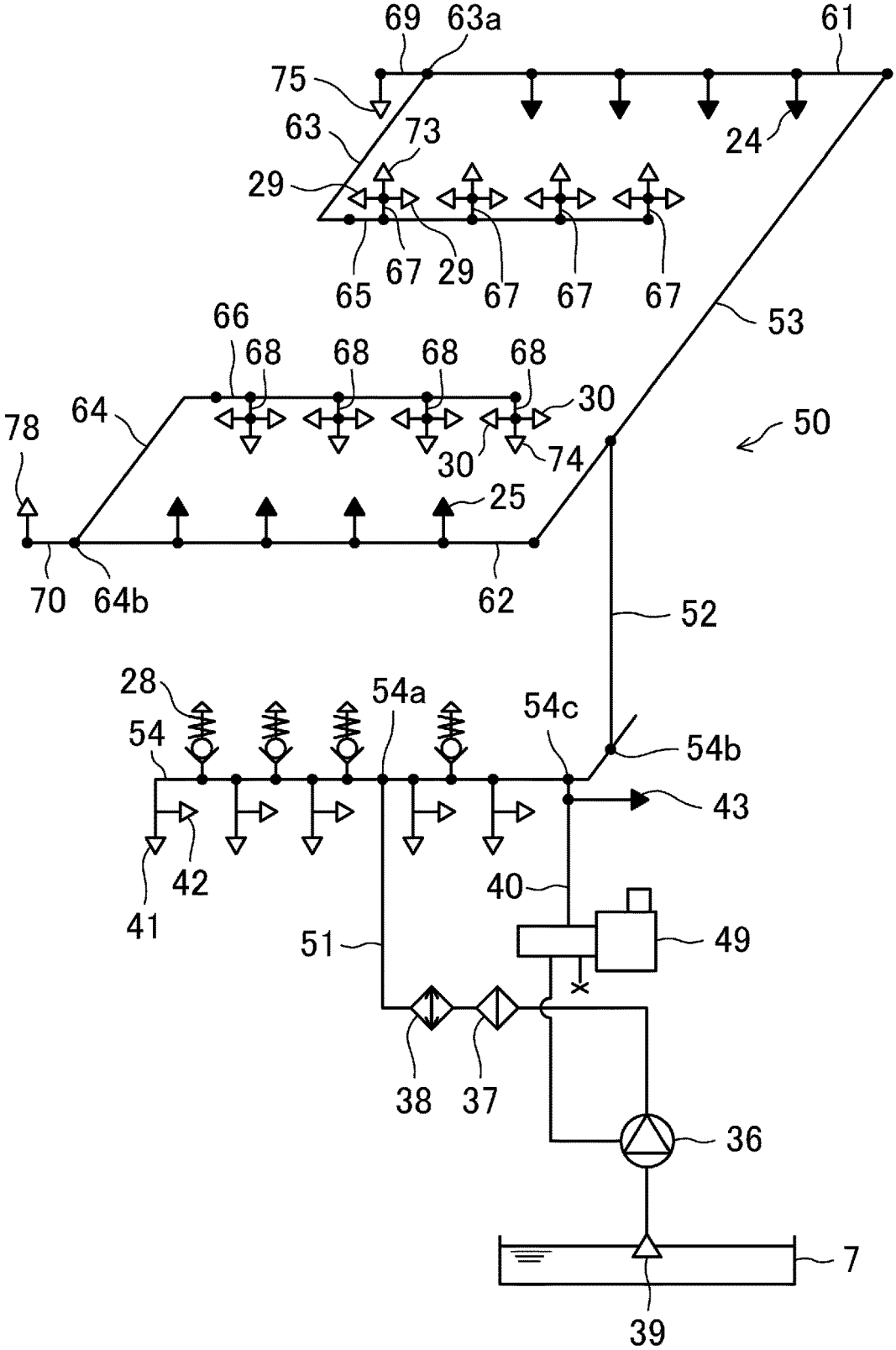
FIG. 2 is a hydraulic circuit diagram illustrating a configuration of oil supply passages of the engine.

Now, referring to FIG. 2, a configuration of an oil supply path 50 for supplying oil to the components of the above engine 2 will be described in detail. As shown in FIG. 2, the oil supply path 50 is connected to an oil pump 36 provided in the engine 2. The oil discharged from the oil pump 36 is supplied through the oil supply path 50 to, for example, parts of the engine 2 to be lubricated. In this exemplary embodiment, the oil pump 36 is a mechanical oil pump, which is driven by the rotation of the crankshaft 11 of the engine 2. The oil pump 36 is a variable oil pump in which the amount of discharge oil is variable in accordance with the pressure input to a pressure chamber of the oil pump 36. Alternatively, the oil pump 36 may be a typical mechanical oil pump, in which the amount of discharge oil is variable depending on speed of the engine 2, or an electric oil pump.

Although will be described later in detail, the oil supply path 50 includes not only the passages passing through the inside of the cylinder head 4 and the cylinder block 5 but also passages passing through pipes, members connected to the pipes and other elements.

The oil supply path 50 includes a first communication passage 51, the main gallery 54, a second communication passage 52, a third communication passage 53, the internal intake passage 61, the internal exhaust passage 62, a connection passage 63 for the intake camshaft, a connection passage 64 for the exhaust camshaft, the oil supply passage 65 for the intake camshaft, the oil supply passage 66 for the exhaust camshaft, four branch passages 67 for the intake camshaft journals, four branch passages 68 for the exhaust camshaft journals, a branch passage 69 for the intake position regulating journal, and a branch passage 70 for the exhaust position regulating journal. The first communication passage 51 is connected to the oil pump 36 and extends from the oil pump 36 to a meeting point 54*a* with the main gallery 54 in the cylinder block 5. The main gallery 54 extends along the cylinder bank in the cylinder block 5. The second communication passage 52 extends from a branching point 54*b* on the main gallery 54 in the cylinder block 5 to the cylinder head 4. The third communication passage 53 extends substantially perpendicularly to the cylinder bank and substantially horizontally in the cylinder head 4. The internal intake passage 61 is connected to the intake-side end of the third communication passage 53, and extends along the cylinder bank on the intake side of the cylinder head 4. The internal exhaust passage 62 is connected to the exhaust-side end of the third communication passage 53 and extends along the cylinder bank on the exhaust side of the cylinder head 4. The connection passage 63 is connected to the downstream end of the internal intake passage 61, passes through an area above the intake camshaft 19, and extends toward the exhaust side of the cylinder head 4. The connection passage 64 is connected to the downstream end of the internal exhaust passage 62, passes through an area above the exhaust camshaft 20, and extends toward the intake side of the cylinder head 4. The oil supply passage 65 is connected to the connection passage 63, and extends along the axis of the intake camshaft 19 above the intake camshaft 19. The oil supply passage 66 is connected to the connection passage 64, and extends along the axis of the exhaust camshaft 20 above the exhaust camshaft 20. The branch passages 67 branch off from the oil supply passage 65. Each branch passage 67 is connected to one of the four bearings 73. The branch passages 68 branch off from the oil supply passage 66. Each branch passage 68 is connected to one of the four bearings 74. The branch passage 69 branches off from the connection passage 63 (specifically, a joint 63*a* between the connection passage 63 and the internal intake passage 61), and is connected to a bearing 75 of a position regulating journal (not shown) formed in the intake camshaft 19. The bearing 75 rotatably supports the position regulating journal. The branch passage 70 branches off from the connection passage 64 (specifically, a joint 64*b* between the connection passage 64 and the internal exhaust passage 62), and is connected to a bearing 78 of a position regulating journal 76 (see FIG. 3) formed in the exhaust camshaft 20. The bearing 78 rotatably supports the position regulating journal 76.

An inlet of the oil pump 36 is connected to an oil strainer 39 facing the oil pan 7. An outlet of the oil pump 36 communicates with the first communication passage 51, in which an oil filter 37 and an oil cooler 38 (also shown in FIG. 1) are arranged in this order from the upstream to the downstream. The oil stored in the oil pan 7 is pumped up by the oil pump 36 through the oil strainer 39, filtered by the oil filter 37, cooled by the oil cooler 38, and then introduced to the main gallery 54 in the cylinder block 5.

The main gallery 54 is connected to the oil jets 28, an oil supply 41, and an oil supply 42. The oil jets 28 are for injecting cooling oil toward the back surfaces of the four pistons 9. The oil supply 41 supplies oil to metal bearings located in five crankshaft journals of the crankshaft 11. The oil supply 42 supplies oil to a bearing ring located on a crank pin of the crankshaft 11, which rotatably connects the four connecting rods 10 together. Oil is always supplied to the main gallery 54.

A branching point 54*c* on the main gallery 54 is connected to an oil supply 43 and an oil passage 40. The oil supply 43 supplies oil to a hydraulic chain tensioner. The oil passage 40 supplies oil to the pressure chamber of the oil pump 36 via a linear solenoid valve 49.

The internal exhaust passage 62 is connected to the HLAs 25. The connection passage 64 connected to the internal exhaust passage 62 supplies the oil, which has passed through the internal exhaust passage 62, to the oil supply passage 66. The four branch passages 68 branch off from the oil supply passage 66. Each of the four branch passages 68 is connected to one of the four bearings 74 and supplies oil to the associated one of the bearings 74. Each branch passage 68 is connected to two of the exhaust oil shower passages 30. The branch passage 70 is connected to the bearing 78 and supplies oil to the bearing 78. Oil is always supplied to these exhaust oil passages 30, 62, 64, 66, 68, and 70.

The intake oil supply passage of the cylinder head 4 is similar to the exhaust oil supply passage. The internal intake passage 61 is connected to the HLAs 24. The connection passage 63 connected to the internal intake passage 61 supplies the oil, which has passed through the internal intake passage 61 to the oil supply passage 65. The four branch passages 67 branch off from the oil supply passage 65. Each of the four branch passages 67 is connected to one of the four bearings 73 and supplies oil to the associated one of the bearings 73. Each branch passage 67 is connected to two of the intake oil shower passages 29. The branch passage 69 is connected to the bearing 75 and supplies oil to the bearing 75. Oil is always supplied to these intake oil passages 29, 61, 63, 65, 67, and 69.

The lubricating or cooling oil supplied to the metal bearings rotatably supporting the crankshaft 11, the pistons 9, the bearings 73, 74, 75, and 78 supporting the intake and exhaust camshafts 19 and 20, and other parts returns to the oil pan 7 through a drain oil passage (not shown) after cooling and lubricating.

Configurations of the intake and exhaust camshafts 19 and 20 and the lubricant supply mechanism for camshaft journals will now be described in detail with reference to FIGS. 3 to 7. The intake and exhaust camshafts 19 and 20 are arranged in the cylinder head 4. The mechanism is for supplying oil to the bearings 73 and 74 of the intake and exhaust camshafts 19 and 20. The configurations of the intake and exhaust camshafts 19 and 20 are substantially the same. Thus, only the configuration of the exhaust camshaft 20 will now be described, and detailed description of the configuration of the intake camshaft 19 will be omitted. The lubricant supply mechanism includes lubricant supply mechanisms on intake and exhaust sides of the cylinder head 4. However, the configurations of the mechanisms on the intake and exhaust sides are substantially the same. Thus, only the configuration of the mechanism on the exhaust side will now be described, and detailed description of the configuration of the mechanism on the intake side will be omitted.

As shown in FIGS. 1 and 3, the exhaust camshaft 20 is located in the cylinder head 4 (specifically, between the cylinder head body 4*a* and the cover 4*b*). The exhaust camshaft 20 includes the camshaft journals 72, the cam pieces 20*a*, and the position regulating journal 76. The camshaft journals 72 (four in this exemplary embodiment) are rotatably supported by the cylinder head body 4*a* and the cam caps 101. The cam pieces 20*a* allow the swing arms 22 (see FIG. 1) to swing. The position regulating journal 76 is provide at or near one axial end of the exhaust camshaft 20 (near the axial end in this exemplary embodiment), and regulates the axial movement of the exhaust camshaft 20. Although not shown, a timing chain sprocket is provided more outward than the position regulating journal 76 in the axial direction of the exhaust camshaft 20. A timing chain for rotating the exhaust camshaft 20 in accordance with the rotation of the crankshaft 11 is wrapped around the timing chain sprocket. A variable valve timing (VVT) mechanism is also provided more outward than the position regulating journal 76 in the axial direction of the exhaust camshaft 20. The VVT mechanism changes the rotation timing of the exhaust camshaft 20 to change the open and close timing of the exhaust valves 14.

The camshaft journals 72 are arranged in the exhaust camshaft 20 at equal intervals along the axis of the exhaust camshaft 20, corresponding to the positions of the four cylinders 8. The four camshaft journals 72 will be hereinafter referred to as a first camshaft journal 72*a*, a second camshaft journal 72*b*, a third camshaft journal 72*c*, and a fourth camshaft journal 72*d* from the side closer to the position regulating journal 76 (i.e., the left in FIG. 3) to the opposite side (i.e., the right in FIG. 3). If there is no need to distinguish them, they are simply referred to as a camshaft journal(s) 72.

Figure 6:
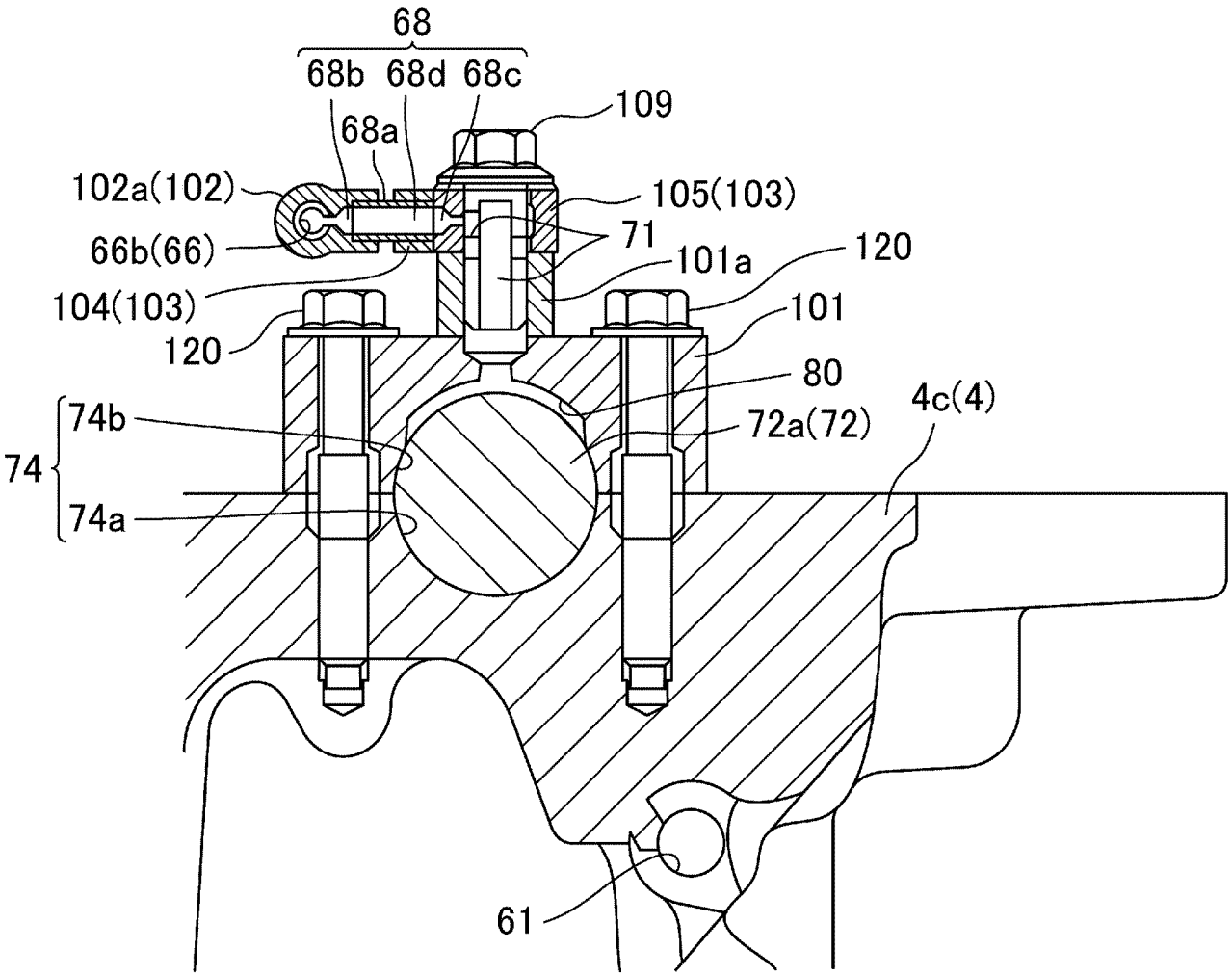
FIG. 6 is a cross-sectional view taken along the line VI-VI of FIG. 4.

Each of the camshaft journals 72*a* to 72*d* is sandwiched between the cylinder head body 4*a* and one of the cam caps 101 attached and fixed to the cylinder head body 4*a* to be supported by the cylinder head body 4*a* and the cam cap 101. Specifically, the cylinder head body 4*a* includes, in the positions corresponding to the camshaft journals 72*a* to 72*d*, the head bearings 74*a* (four in this exemplary embodiment), which are recessed downward to form a semicircular shape as viewed along the axis of the exhaust camshaft 20. On the other hand, the cam caps 101 include the cam cap bearings 74*b*, respectively, which are recessed upward to form a semicircular shape as viewed along the axis. As shown in FIG. 6, the circumferential ends of the head bearings 74*a* and the cam cap bearings 74*b* butt against each other in a vertical direction to form the bearings 74 in a circular shape as viewed along the axis. In these bearings 74, the camshaft journals 72*a* to 72*d* are sandwiched between the cylinder head body 4*a* and the respective cam caps 101 of the camshaft journals 72 to be rotatably and pivotally supported.

The cam caps 101 abut on the cylinder head body 4*a* to sandwich the respective camshaft journals 72, and are then fixed to the cylinder head body 4*a* by two bolts 120 (see FIG. 6). Cylindrical projections 101*a* project upward from the upper surfaces of the cam caps 101. Although will be described later in detail, the insides of the projections 101*a* serve as bolt holes. To the bolt holes, bolts 109 for connecting the branch passages 68 to the cam caps 101 are fastened.

As shown in FIG. 3, each of the cam pieces 20*a* is provided at one of portions of the exhaust camshaft 20 on the respective sides of one of the camshaft journals 72 in the direction along the axis of the exhaust camshaft 20 to be adjacent to the camshaft journal 72. According to this exemplary embodiment, explosion strokes (i.e., exhaust strokes) of the cylinders are performed sequentially in the combustion cycle of the engine 2. The cam pieces 20*a* for each cylinder 8 are arranged so that their apexes are aligned along the circumference of the camshaft to meet the explosion stroke (i.e., exhaust stroke) of the cylinder 8. On the other hand, the cam pieces 20*a* for the different cylinders 8 are arranged so that their apexes are shifted at predetermined angels along the circumference of the exhaust camshaft 20.

The position regulating journal 76 has a larger diameter than the camshaft journals 72*a* to 72*d* to regulate the axial movement of the exhaust camshaft 20. The position regulating journal 76 are sandwiched between the cylinder head body 4*a* and a cam cap 108 for the position regulating journal, which is attached and fixed to the cylinder head body 4*a* to be supported by the cylinder head body 4*a* and the cam cap 108. Specifically, as shown in FIG. 3, the cylinder head body 4*a* includes, in the position corresponding to the position regulating journal 76, a head bearing 78*a* for the position regulating journal, which is recessed downward to form a semicircular shape as viewed along the axis of the exhaust camshaft 20. On the other hand, the cam cap 108 includes a cam cap bearing 78*b* for the position regulating journal, which is recessed upward to form a semicircular shape as viewed along the axis. The circumferential ends of the head bearing 78*a* and the cam cap bearing 78*b* butt against each other in a vertical direction to form the bearing 78 in a circular shape as viewed along the axis. In this bearing 78, the position regulating journal 76 is sandwiched between the cylinder head body 4*a* and the cam cap 108 to be rotatably and pivotally supported. FIG. 3 shows a head bearing 75*a* for the position regulating journal, which is the lower half of the bearing 75. A cam cap bearing for the position regulating journal, which is the upper half of the bearing 75 is however not shown.

In the oil supply path 50, the first communication passage 51, the main gallery 54, the second communication passage 52, the third communication passage 53, the internal intake passage 61, the connection passage 63, the oil supply passage 65, and the four branch passages 67 form the lubricant supply mechanism for the camshaft journals on the intake side. On the other hand, the first communication passage 51, the main gallery 54, the second communication passage 52, the third communication passage 53, the internal exhaust passage 62, the connection passage 64, the oil supply passage 66, and the four branch passages 68 form the lubricant supply mechanism for the camshaft journals on the exhaust side. The first communication passage 51, the main gallery 54, the second communication passage 52, and the third communication passage 53 are common oil supply passages between the mechanisms on the intake and exhaust sides.

The oil supply path of the mechanism on the exhaust side includes, in addition to the common oil supply passages, the internal exhaust passage 62, the connection passage 64, the oil supply passage 66, and the four branch passages 68.

The oil supply passage 66 is located above the exhaust camshaft 20, and extends along the axis of the exhaust camshaft 20. The connection passage 64 connects the upstream end of the oil supply passage 66 to the internal exhaust passage 62 formed in the cylinder head 4.

The four branch passages 68 branch at four portions (i.e., in the positions corresponding to the camshaft journals 72*a* to 72*d*) from the oil supply passage 66. Each of the four branch passages 68 is connected to one of the four bearings 74 from above and supplies oil to the associated one of the bearings 74. Each branch passage 68 extends from the oil supply passage 66 toward the associated one of the camshaft journals 72 in the horizontal direction perpendicular to the axis of the exhaust camshaft 20.

In this exemplary embodiment, as described above, each branch passage 68 is connected to two of the exhaust oil shower passages 30. Each two exhaust oil shower passages 30 connected to one of the branch passages 68 extend along the axis of the exhaust camshaft 20 toward the two cam pieces 20*a*, which are located on the respective sides of associated one of the camshaft journals 72 in the direction along the axis.

The branch passage 70 connected to the bearing 78 branches from the connection passage 64 (specifically, the joint 64*b*).

The connection passage 64, the oil supply passage 66, and the branch passages 68 are members separate from and attached to the cylinder head 4 (specifically, the cylinder head body 4*a*). The exhaust oil shower passages 30 and the branch passage 70 also pass through members separate from the cylinder head 4.

Specifically, the connection passage 64 passes through a pipe 64*a* and a cylindrical joint member 64*d*. The pipe 64*a* bends in a substantially L-shape. The joint member 64*d* connects the pipe 64*a* to the internal exhaust passage 62. That is, the connection passage 64 includes an oil passage 64*c* in the pipe 64*a*, and the joint 64*b* formed in the joint member 64*d*. In FIG. 3, although the joint member 64*d* is divided into two parts, an upper part and a lower part, these two parts are eventually stacked one on the other in the vertical direction to be integral. Although the joint 64*b* is open on the upper surface of the joint member 64*d* (specifically, the upper surface of the upper part), this opening is covered by a blocking member (not shown).

The oil supply passage 66 passes through a pipe 66*a*, and T-shaped joints 102 (four in this exemplary embodiment) provided in the pipe 66*a*. That is, the oil supply passage 66 includes an oil passage 66*c* in the pipe 66*a* and an oil passage 66*b* (see FIG. 5) extending in the joint 102 along the axis of the exhaust camshaft 20. The pipe 66*a* is cut at the joints 102 and divided into divisional pipes.

Figure 5:
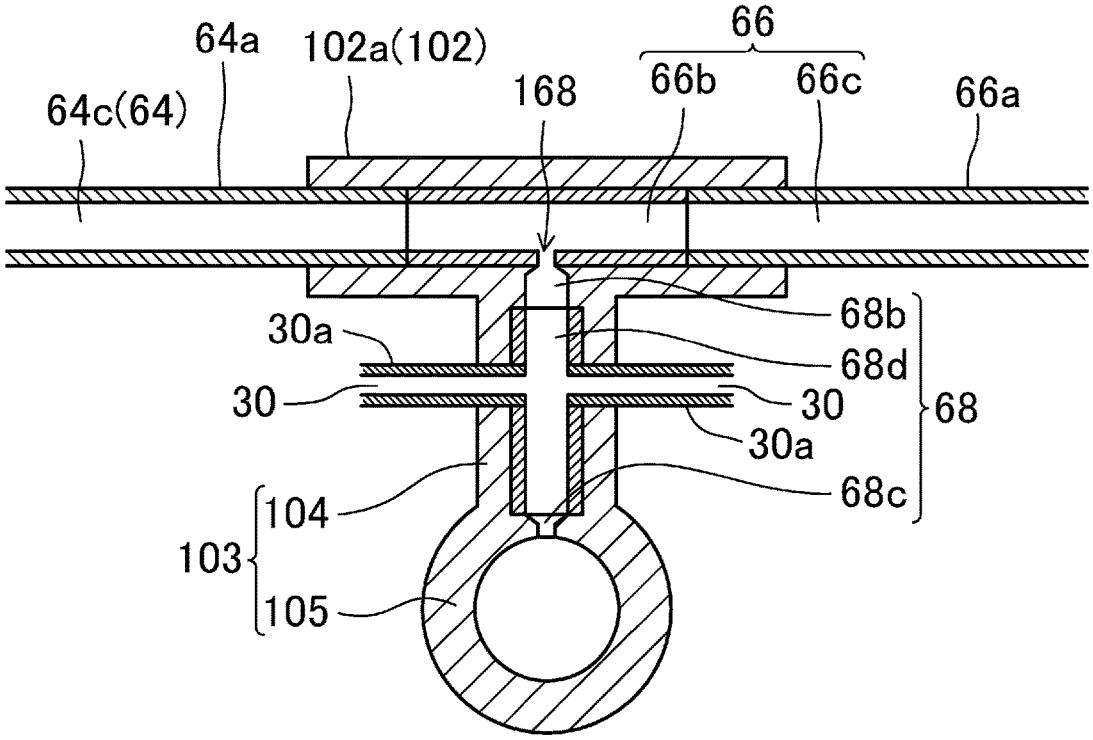
FIG. 5 is a cross-sectional view illustrating that oil supply passages for the camshaft, a connection passage for the camshaft and branch passages for the camshaft journals are connected to each other via joints.

Each branch passage 68 passes through, as shown in FIG. 5, a pipe 68*a*, one of the joints 102, and a fixing members 103. The fixing member 103 connects the downstream end of the associated one of the branch passages 68 to one of the cam caps 101. That is, each branch passage 68 passes through an oil passage 68*d* in the pipe 68*a*, an oil passage 68*b* extending in the joint 102 in the horizontal direction perpendicular to the axis, and an oil passage 68*c* in the fixing member 103.

Each exhaust oil shower passage 30 passes through a pipe 30*a*. The pipe 30*a* is integrally connected to associated one of the pipes 68*a*. The branch passage 70 passes through, as will be described later, the cam cap 108 attached and fixed to the cylinder head body 4*a*.

The four joints 102 corresponding to the four branch passages 68 will be hereinafter referred to as a first joint 102*a*, a second joint 102*b*, a third joint 102*c*, and a fourth joint 102*d* from the side closer to the position regulating journal 76 to the opposite side. If there is no need to distinguish them, they are simply referred to as a joint(s) 102.

Each joint 102 is integrally connected to the pipe 66*a* and one of the pipes 68*a*, which is a part of the associated one of the branch passages 68. The first joint 102*a* is also integrally connected to the pipe 64*a*. Each fixing member 103 is integrally connected to one of the pipes 68*a*. These members may be connected by various types of methods such as welding. In particular, connection by brazing is preferable. In order to connect the members by brazing, the pipes 66*a* and 68*a* are inserted into the joints 102 and the fixing members 103 with a brazing material attached to the pipes 66*a* and 68*a* (including the pipe 64*a* at the first joint 102*a* (hereinafter the same)). The brazing material is provided at the connecting points between the pipes 66*a* and the joints 102, between the pipes 68*a* and the joints 102, and between the pipes 68*a* and the fixing members 103. The connection points are heated to allow the brazing material to flow into the gaps between the pipes 66*a* and the joints 102, between the pipes 68*a* and the joints 102, and between the pipes 68*a* and the fixing members 103. As a result, the pipes 66*a* and 68*a* and the joints 102, and the pipes 68*a* and the fixing members 103 are integrally connected to each other by brazing. The connection points may be heated one by one, but may be heated at once, for example, in an oven to simplify the manufacturing process.

Figure 4:
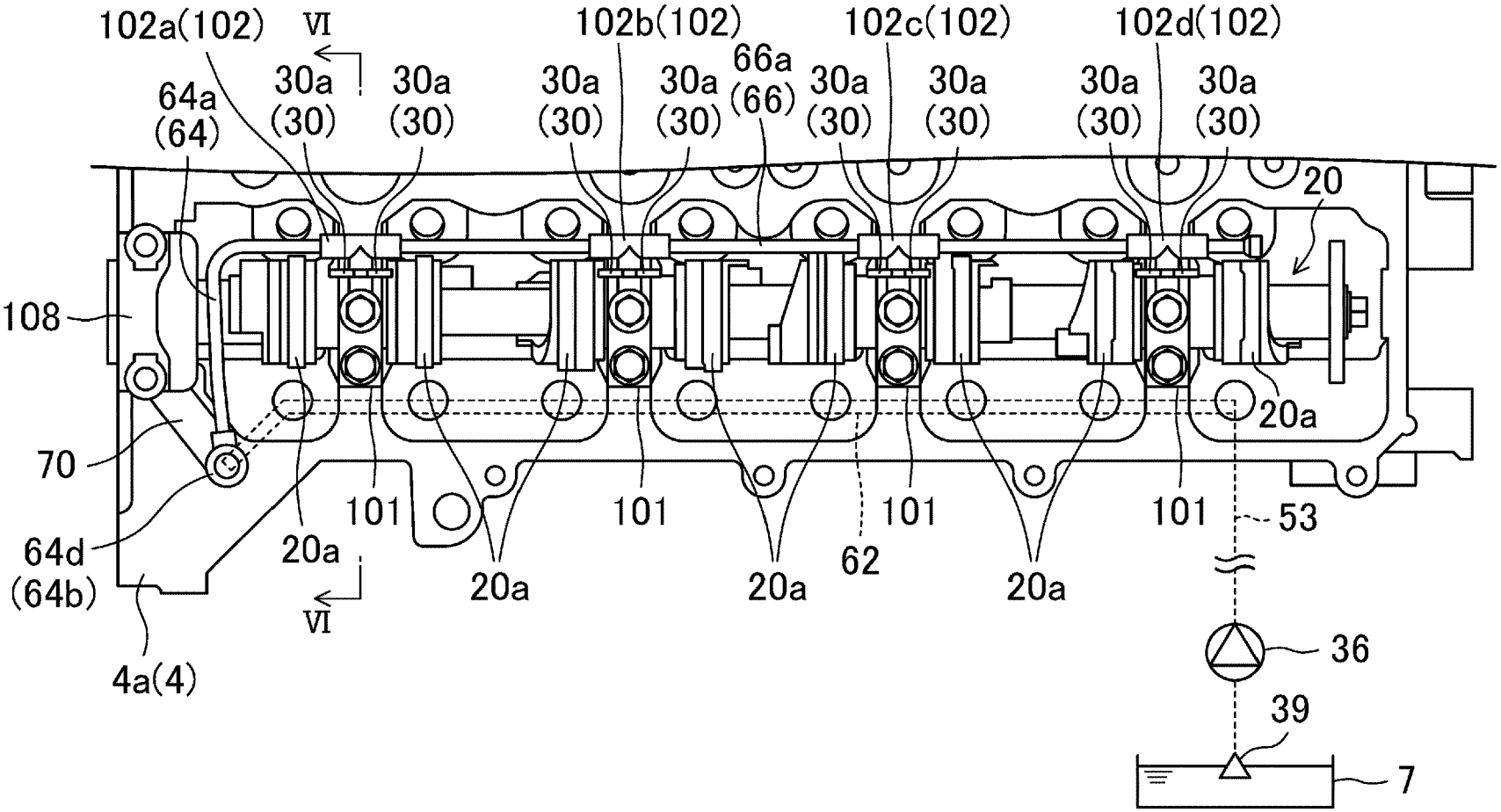
FIG. 4 illustrates the section of the cylinder head around the camshaft as seen from above.

As shown in FIG. 3, the downstream end of the internal exhaust passage 62 is open in a position near the position regulating journal 76 in the upper surface of the cylinder head body 4*a*. As shown in FIG. 4, the joint member 64*d* is fixed around the opening of the internal exhaust passage 62 in the upper surface of the cylinder head body 4*a*. In this manner, the internal exhaust passage 62 is connected to the upstream end of the connection passage 64 via the joint 64*b* (i.e., the joint member 64*d*).

The pipe 64*a* of the connection passage 64 extends obliquely upward from the joint member 64*d* through a region above the exhaust camshaft 20 and near the inner side of the position regulating journal 76 in the direction along the axis of the exhaust camshaft 20 toward the intake side. Then, the pipe 64*a* bends to be parallel with the axis and extends along the axis. The downstream end of the pipe 64*a* is connected to the first joint 102*a*. The end of the first joint 102*a* farther from the pipe 64*a* is connected to the pipe 66*a*.

The pipe 64*a* may extend vertically upward from the joint member 64*d*, bend substantially perpendicular toward the intake side, extend above the exhaust camshaft 20 horizontally, that is, substantially orthogonal to the axis. Then, the pipe 64*a* may bend to be parallel with the axis, and extend along the axis.

As shown in FIGS. 3 and 4, the second to fourth joints 102*b* to 102*d* connect the divisional pipes of the pipe 66*a*. The downstream end of the pipe 66*a* (the downstream end of the divisional pipe located downstream of the fourth joint 102*d*) is crashed to be closed.

As shown in FIG. 5, one of the oil passages 66*b*, which is a part of the oil supply passage 66, and one of the oil passages 68*b*, which is a part of the associated one of the branch passages 68, pass through the inside of the joints 102 (the first joint 102*a* is shown in FIG. 5). The oil passages 66*b* in the first joint 102*a* communicate with the downstream end of the connection passage 64 (i.e., the oil passage 64*c* in the pipe 64*a*) and the oil passage 66*c* in the pipe 66*a*. The oil passages 66*b* in the second to fourth joints 102*b* to 102*d* communicate with the oil passage 66*c*, which is one of two divisional pipes adjacent to the pipe 66*a*.

The branch passages 68 (the oil passages 68*b*) branch off from the oil supply passage 66 (i.e., the oil passages 66*b*) in the associated joints 102. The upstream end of the pipe 68*a* of each branch passage 68 is connected to one of the joints 102. On the other hand, the downstream end is connected to one of the fixing members 103. The oil passage 68*d* in the pipe 68*a* communicates with one of the oil passages 68*b*, and one of the oil passages 68*c* in the fixing members 103.

Each fixing member 103 includes a joint 104 connected to the associated one of the pipes 68*a*, and a ring fixture 105 fixed onto one of the cam caps 101. The downstream ends of the branch passages 68 (i.e., the downstream ends of the oil passages 68*c*) face the insides of the fixtures 105. The insides of the fixtures 105 serve as bolt holes. To the bolt holes, bolts 109 for fixing the fixing members 103 to the cam caps 101 and connecting the branch passages 68 to the cam caps 101 are fastened.

Each branch passage 68 (i.e., each pipe 68*a*) is connected to one of the cam caps 101 by one of the fixing members 103. Specifically, the fixtures 105 of the fixing members 103 are mounted on the projections 101*a* of the cam caps 101 so that the bolt holes of the projections 101*a* communicate with the bolt holes of the fixtures 105 in the vertical direction. After that, the bolts 109 are screwed into the bolt holes of the projections 101*a* and the bolt holes of the fixtures 105 to fasten the cam caps 101 to the fixing members 103. The connection of the branch passages 68 to the cam caps 101 fixes the oil supply passage 66 to the cam caps 101 via the joints 102. As a result, the members forming the oil supply passage 66, the connection passage 64 and the branch passages 68 (i.e., the pipe 64*a*, the joint member 64*d*, the pipe 66*a*, the joints 102, the pipes 68*a*, and the fixing members 103) are directly or in directly attached and fixed to the cylinder head 4 (i.e., the cylinder head body 4*a*). In this manner, the members are attached and fixed to the cylinder head 4 (i.e., the cylinder head body 4*a*) at the plurality of points (i.e., the joint member 64*d* and the fixing members 103). This reduces vibrations of, particularly, the long oil supply passage 66 in accordance with the vibration of the engine 2. The pipes 30*a* forming the exhaust oil shower passages 30 are indirectly attached and fixed to the cylinder head 4 (i.e., the cylinder head body 4*a*).

As shown in FIG. 6, a substantially L-shaped in-bolt oil passage 71 passes through each bolt 109. If the bolt 109 is to be used to fasten one of the cam caps 101 to associated one of the fixing members 103, the upstream end of the in-bolt oil passage 71 is connected to the downstream end of the oil passage 68*c* in the fixing member 103. The downstream end of the in-bolt oil passage 71 is connected to one of the bearings 74. As a result, each branch passage 68 is connected to the bearings 74 from above (right above in this exemplary embodiment) via one of the in-bolt oil passages 71.

The flow of oil from the oil supply passage 66 to the bearings 74 will now be described in detail.

First, the oil, which has flowed from the oil supply passage 66 into the oil passages 68*b* of the branch passages 68 in the joints 102, flows through the oil passages 68*d* in the pipes 68*a* and the oil passages 68*c* in the fixing members 103 into the in-bolt oil passages 71. The oil, which has flowed into the in-bolt oil passages 71, is supplied through the in-bolt oil passages 71 to the bearings 74. The oil, which has flowed into the oil passages 68*b* in this manner, is supplied from above (right above) to the bearings 74.

As shown in FIG. 6, in an upper part of each cam cap bearing 74*b*, an oil groove 80 recessed upward is formed. One of the branch passages 68 is connected to the uppermost portion of the oil groove 80. The oil, which has been supplied to the bearing 74 (the uppermost portion of the oil groove 80) spreads throughout the oil groove 80. The exhaust camshaft 20 rotates in accordance with the rotation of the crankshaft 11 so that the oil spreads from the oil groove 80 to the entire bearing 74. In this manner, an oil film is formed over the entire bearing 74.

Each branch passage 68 includes a throttle 168, which has a smaller cross-sectional flow area than the oil supply passage 66. Specifically, as shown in FIG. 5, the branch passage 68 includes, at the point at which the branch passage 68 branches off from the oil supply passage 66 in the oil passage 66*b* inside the joint 102, the throttle 168 with a smaller cross-sectional flow area than the oil supply passage 66. Due to the formation of such a throttle 168, the oil hardly flows from the oil supply passage 66 to the branch passages 68. Specifically, the pressure of oil in the oil supply passage 66 needs to be high enough to allow the oil to pass through the throttle 168. Otherwise, no oil is supplied to the four bearings 74 via the four branch passages 68. Note that the "cross-sectional flow area" means the cross-sectional area taken along the plane perpendicular to the circulation of the oil.

The throttle 168 has such a cross-sectional flow area that even pressure (i.e., even amount) of oil is supplied to all the bearings 74 associated with the camshaft journals 72 regardless of the speed of the oil pump 36 or the temperature of oil, in other words, regardless of the discharge pressure of oil or the viscosity of oil. Specifically, the throttle 168 has the following cross-sectional flow area. After oil has filled the oil supply passage 66, the pressure of oil in the oil supply passage 66 becomes high enough to allow the oil to pass through the throttle 168. Then, the oil flows into the branch passages 68. The pressure (i.e., the amount) of the oil supplied to the bearings 74 may largely vary when the engine 2 operates in a range such as a high-speed operation in which a high load tends to be applied and the oil tends to have a high temperature (i.e., the oil has a low viscosity) or when the engine 2 rotates at a low speed (i.e., the oil is discharged at a low pressure).

As shown in FIGS. 4 and 5, the two exhaust oil shower passages 30 as oil supply passages for the cam pieces branch from a portion of each branch passage 68 upstream of its downstream end and downstream of the throttle 168. In FIG. 3, the exhaust oil shower passages 30 are not shown. These two exhaust oil shower passages 30 extend along the axis of the exhaust camshaft 20 from the branch passage 68 toward the two cam pieces 20*a* located on both the sides of the camshaft journal 72 associated with the branch passage 68 in the direction along the axis of the exhaust camshaft 20. With this configuration, part of the oil circulating through the branch passage 68 flows into the exhaust oil shower passages 30 and drops down to the cam pieces 20. In this exemplary embodiment, the part of oil also drops down to the contacts between the swing arms 21 and 22 and the cam followers 21*a* and 22*a*. As shown in FIG. 5, the oil passage 68*c* in each fixing member 103 has a portion with a smaller cross-sectional flow area than the exhaust oil shower passages 30. This facilitates the flow of oil from the branch passage 68 to the exhaust oil shower passages 30.

Figure 7:
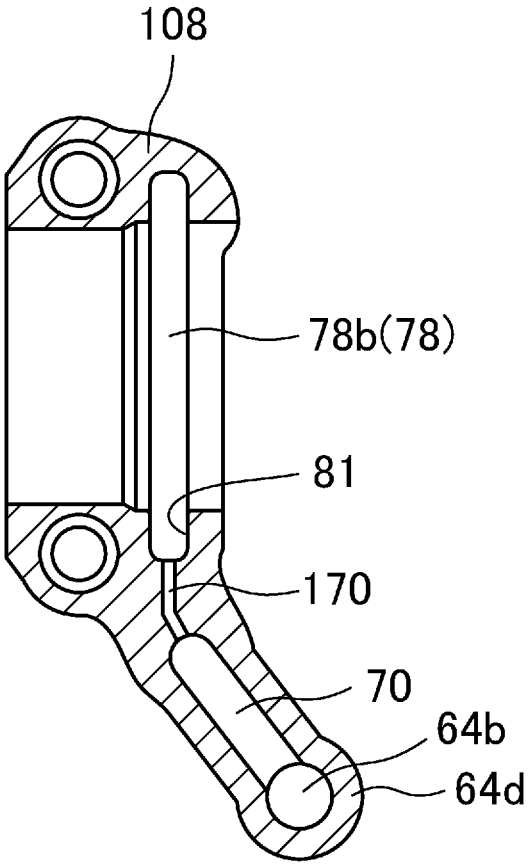
FIG. 7 is a cross-sectional view illustrating a configuration of an exhaust branch passage for a position regulating journal.

The branch passage 70 branches off from a portion of the connection passage 64 below the uppermost portion of the exhaust camshaft 20 (the joint 64*b* between the connection passage 64 and the internal exhaust passage 62 in this exemplary embodiment) to be located below the uppermost portion of the exhaust camshaft 20. As shown in FIG. 7, this branch passage 70 passes through the inside of the cam cap 108. The downstream end of the branch passage 70 communicates with an oil groove 81 for the position regulating journal. The oil groove 81 is provided in the bearing 78*b* of the cam cap 108. This oil groove 81 is the same or similar to the oil grooves 80 of the bearings 74. The downstream end of the branch passage 70 is connected not to the uppermost portion of the oil groove 81 but to a portion lower than the uppermost portion (the lowermost portion in this exemplary embodiment).

Part of the oil, which has circulated through the internal exhaust passage 62, flows through the branch passage 70 into the lowermost portion of the oil groove 81, and then spreads throughout the oil groove 81. The oil spreads to the entire bearing 78 in accordance with the rotation of the exhaust camshaft 20. In this manner, an oil film is formed over the entire bearing 78.

As shown in FIG. 7, at a downstream portion of the branch passage 70, a throttle 170 with a smaller cross-sectional flow area than the upstream of the branch passage 70 is provided. With this configuration, unless the pressure of oil in the connection passage 64 is high enough to allow the oil to pass through the throttle 170, no oil is supplied to the bearing 78 through the branch passage 70. In this manner, even if the oil flows into the branch passage 70, the throttle 170 stops the oil once and thus the pressure of oil in the connection passage 64 hardly decreases. This enables supply of oil to the oil supply passage 66 and the branch passages 68 through the connection passage 64.

In the above description, the configurations of the intake camshaft 19 and the lubricant supply mechanism for camshaft journals on the intake side are as follows. The "camshaft journals 72" are replaced with the "camshaft journals of the intake camshaft 19." The "bearings 74" of the exhaust camshaft journals are replaced with the "bearings 73" of the intake camshaft journals. The "position regulating journal 76" is replaced with the "position regulating journal of the intake camshaft 19." The "internal exhaust passage 62" is replaced with the "internal intake passage 61." The "connection passage 64" for the exhaust camshaft is replaced with the "connection passage 63" for the intake camshaft. The "oil supply passage 66" for the exhaust camshaft is replaced with the "oil supply passage 65" for the intake camshaft. The "branch passages 68" for the exhaust camshaft journals are replaced with the "branch passages 67" for the intake camshaft journals. The "branch passage 70" for the exhaust position regulating journal is replaced with the "branch passage 69" for the intake position regulating journal. The "exhaust oil shower passages 30" are replaced with the "intake oil shower passages 29." The "bearings 74" of the exhaust camshaft journals are replaced with the "bearings 73" of the intake camshaft journals. The "bearing 78" of the exhaust position regulating journal is replaced with the "bearing 75" of the intake position regulating journal.

The cylinder head 4 includes not only the intake and exhaust camshafts 19 and 20 but also various types of devices such as fuel injectors and ignition plugs. The cylinder head body 4*a* needs to have, for each of the cylinders 8, mounts (not shown) for a fuel injector and an ignition plug. If precise combustion control is required to, for example, improve the thermal efficiency of the engine, two ignition plugs may be mounted. The number of the mounts corresponding to the number of the devices need to be provided.

If additional devices are provided in the cylinder head 4 in this manner, mounts for the devices need to be formed, while avoiding the oil supply passages in the cylinder head body 4*a*, the devices need to be arranged in positions out of the oil supply passages. Thus, complicated oil supply passages in the cylinder head body 4*a* render the formation of the additional devices difficult in the cylinder head 4.

To address the problem, in this exemplary embodiment, the oil supply passage 66, the connection passage 64, and the branch passages 68 are members separate from the cylinder head 4. These passages supply oil to the bearings 74 from above. There is thus no need to form oil supply passages communicating with the bearings 74 in the cylinder head 4. The lubricant supply mechanism on the intake side has the same or similar configuration as the lubricant supply mechanism on the exhaust side. There is thus no need to form oil supply passages communicating with the bearings 73 in the cylinder head body 4*a*. This facilitates the formation of the mounts for the devices in the cylinder head body 4*a*. The additional devices are thus arranged in the cylinder head 4 relatively easy. This configuration easily accepts additional devices to be provided in the cylinder head 4.

On the other hand, as in this exemplary embodiment, if oil is supplied to the bearings 73 and 74 from above, the oil needs to flow up to the position above the intake and exhaust camshafts 19 and 20 to flow into the oil supply passages 65 and 66. The flow rate (i.e., pressure) of oil decreases as the oil flows downstream of the oil supply passages 65 and 66. This may cause variations in the pressure of oil supplied to the (four) bearings 73 for the intake camshaft journals and to the (four) bearings 74 for the exhaust camshaft journals.

However, in this exemplary embodiment, each branch passage 68 includes, at the point in which the branch passage 68 branches off from the oil supply passage 66, the throttle 168 with a smaller cross-sectional flow area than the oil supply passage 66. Unless the pressure of oil in the oil supply passage 66 is high enough to allow the oil to pass through the throttle 168, no oil is supplied to the four bearings 74 via the four branch passages 68. With this configuration, the oil is supplied to the bearing 74 connected to an upstream portion of the oil supply passage 66 (e.g., the bearing 74 supporting the first camshaft journal 72*a*) not before being supplied to the bearing 74 connected to a downstream portion of the oil supply passage 66 (e.g., the bearing 74 supporting the fourth camshaft journal 72*d*). When the oil fills the entire oil supply passage 66 and the pressure of oil in the oil supply passage 66 becomes high enough to allow the oil to circulate through the throttle 168, the oil in the oil supply passage 66 is supplied at once to the four bearings 74 via the four branch passages 68. This reduces variations in the pressure (i.e., amount) of oil supplied to the four bearings 74 for the exhaust camshaft journals. As described above, since the lubricant supply mechanism on the intake side has the same or similar configuration as the lubricant supply mechanism on the exhaust side, Variations in the pressure (i.e., amount) of oil supplied to the four bearings 73 for the intake camshaft journals can also be reduced.

In this exemplary embodiment, from the portion of each branch passage 68 upstream of its downstream end and downstream of the throttle 168 toward the two cam pieces 20*a*, the two exhaust oil shower passages 30 extending along the axis of the exhaust camshaft 20 branch off. Similarly, from each branch passage 67, the two intake oil shower passages branch off. In this manner, the intake and exhaust oil shower passages 29 and 30 branch off from the portion of the associated one of the branch passages 67 and 68 downstream of the throttle 168, respectively. As a result, the oil can be supplied from a position close to the cam pieces 19*a* and 20*a* to the cam pieces 19*a* and 20*a* as well as the contacts between the swing arms 21 and 22 and the cam followers 21*a* and 22*a*. This enables the supply of oil to the cam pieces 19*a* and 20*a* as well as the contacts at a relatively low pressure.

The oil is supplied to the bearings 73 and 74 from above. The intake and exhaust oil shower passages 29 and 30 branch off from the portion of the associated one of the branch passages 67 and 68 downstream of the throttle 168, respectively. This facilitates the arrangement of the intake and exhaust oil shower passages 29 and 30 above the cam pieces 19*a* and 20*a*. As a result, there is no need to provide extra oil passages for supplying oil to the intake and exhaust oil shower passages 29 and 30 to be arranged above the cam pieces 19*a* and 20*a*. This simplifies the entire configuration of the oil supply path 50.

In addition, the intake and exhaust oil shower passages 29 and 30 need to have relatively short lengths. This also simplifies the entire configuration of the oil supply path 50.

In this exemplary embodiment, the branch passage 70 supplying oil to the bearing 78 branches off from the joint 64*b* between the connection passage 64 and the internal exhaust passage 62 and is located in a position lower than the exhaust camshaft 20. The lubricant supply mechanism for the camshaft journals on the intake side has the same or similar configuration as the lubricant supply mechanism for the camshaft journals on the exhaust side. The engine 2 can be thus downsized.

Specifically, although the oil needs to be supplied to the bearing 78, the position regulating journal 76 has a larger diameter than the camshaft journals 72. If the branch passage 70 branches off from the oil supply passage 66 and the oil is to be supplied to the bearing 78 from above, the oil supply passage 66 needs to be located high enough to meet the diameter of the position regulating journal 76. Otherwise, the cover 4*b* needs to have a larger vertical size. This increases the vertical size of the engine 2 as a whole.

To address the problem, as in this exemplary embodiment, the branch passage 70 branches off from the joint 64*b* between the connection passage 64 and the internal exhaust passage 62 so as to be located in a position lower than the uppermost potion of the exhaust camshaft 20. Similarly, the branch passage 69 branches off from the joint 63*a* between the connection passage 63 and the internal intake passage 61 so as to be located in a position lower than the uppermost potion of the intake camshaft 19. This prevents or reduces an increase in the vertical size of the engine 2 as a whole. This also reduces the lengths of the branch passages 69 and 70.

The present invention is not limited to the exemplary embodiment described above. Any replacement may be made within the scope of the claims.

For example, in the exemplary embodiment, the oil supply passage 66 is closer to the intake side than the exhaust camshaft 20, and the oil supply passage 65 is closer to the exhaust side than the intake camshaft 19. The present invention is not limited thereto. The oil supply passage 66 may be closer to the exhaust side than the exhaust camshaft 20 and the oil supply passage 65 may be closer to the intake side than the intake camshaft 19.

In the exemplary embodiment, the oil supply passage 66, the connection passage 64, and the branch passages 68 are formed of the pipe 64*a*, the joint member 64*d*, the pipe 66*a*, the joints 102, the pipes 68*a*, and the fixing members 103. The present invention is not limited thereto. These passages may be formed of any members separate from the cylinder head 4 and capable of serving as the passages.

In the exemplary embodiment, the two intake oil shower passages 29 branch off from each branch passage 67, and the two exhaust oil shower passages 30 branch off from each branch passage 68. The present invention is not limited thereto. If a cam piece 20*a* is provided at only one of the two portions of the exhaust camshaft 20 on both the sides of the camshaft journals 72 in the direction along the exhaust camshaft 20, one of the exhaust oil shower passages 30 branches off from each branch passage 68 and extends toward the cam piece 20*a* along the axis of the exhaust camshaft 20. The intake oil shower passages 29 have the same or similar configuration.

In the exemplary embodiment described above, each branch passage 68 includes the throttle 168 at the point at which the branch passage 68 branches off from the oil supply passage 66 in the oil passage 66*b* formed inside the joint 102. The present invention is not limited thereto. The throttle 168 may be provided at a portion of the branch passage 68 other than the branching point (e.g., in the pipe 66*a*).

In the exemplary embodiment, the branch passage 69 branches off from the joint 63*a* between the connection passage 63 and the internal intake passage 61, and the branch passage 70 branches off from the joint 64*b* between the connection passage 64 and the internal exhaust passage 62. The present invention is not limited thereto. As long as the branch passages 69 and 70 are located in a position lower than the uppermost portions of the intake and exhaust camshafts 19 and 20, the branch passages 69 and 70 may branch off from any points in the intake and exhaust connection passages 63 and 64. However, the present invention is applicable to the case where the branch passages 69 and 70 are located above the uppermost portions of the intake and exhaust camshafts 19 and 20.

The embodiments described above are mere examples, and are not to be construed as limiting the scope of the present invention. The scope of the present invention is defined by the claims. Variations and modifications of equivalents of the claims are intended to fall within the scope of the present invention.

INDUSTRIAL APPLICABILITY

The present invention is useful as a lubricant supply mechanism for camshaft journals of an engine including a camshaft, provided in a cylinder head and including the camshaft journals, and bearings, each rotatably supporting one of the camshaft journals of the camshaft.

DESCRIPTION OF REFERENCE CHARACTERS

2 Engine
4 Cylinder Head
19 Intake Camshaft
19*a* Cam Piece
20 Exhaust Camshaft
20*a* Cam Piece
29 Intake Oil Shower Passage (Oil Supply Passage for Cam Piece)
30 Exhaust Oil Shower Passage (Oil Supply Passage for Cam Piece)
36 Oil Pump
50 Oil Supply Passage
61 Internal Intake Passage
62 Internal Exhaust Passage
63 Connection Passage for Intake Camshaft
63*a* Joint between Connection Passage for Camshaft and Internal Passage
64 Connection Passage for Exhaust Camshaft
64*b* Joint between Connection Passage for Camshaft and Internal Passage
65 Oil Supply Passage for Intake Camshaft
66 Oil Supply Passage for Exhaust Camshaft
67 Branch Passage for Intake Camshaft Journal
68 Branch Passage for Exhaust Camshaft Journal
69 Branch Passage for Intake Position Regulating Journal
70 Branch Passage for Exhaust Position Regulating Journal
72 Camshaft Journal of Intake Camshaft
73 Bearing of Intake Camshaft Journal
74 Bearing of Exhaust Camshaft Journal

75 Bearing of Intake Position Regulating Journal
76 Position Regulating Journal of Exhaust Camshaft
78 Bearing of Exhaust Position Regulating Journal
168 Throttle

The invention claimed is:

1. A lubricant supply mechanism for camshaft journals of an engine including a camshaft, provided in a cylinder head and including the camshaft journals, and bearings, each rotatably supporting one of the camshaft journals of the camshaft, the mechanism comprising:

an oil supply path passing through members separate from and attached to the cylinder head to supply a lubricant discharged from an oil pump in the engine to the bearings, wherein the oil supply path includes an oil supply passage for the camshaft located above the camshaft and extending along an axis of the camshaft, a connection passage for the camshaft located between the oil supply passage for the camshaft and an internal passage in the cylinder head, and supplying the lubricant having passed through the internal passage to the oil supply passage for the camshaft, and branch oil passages for the camshaft journals, each branch oil passage branching off from the oil supply passage for the camshaft, connected to a respective bearing of the bearings from above, and supplying the lubricant to the respective bearing of the bearings, each of the branch oil passages includes a throttle with a smaller cross-sectional flow area than the oil supply passage for the camshaft, a cam piece is provided at at least one of two portions of the camshaft on two sides of each of the camshaft journals in a direction along the axis of the camshaft, and an oil supply passage for the cam piece branches off from a portion of each of the branch oil passages located upstream of a downstream end of each of the branch oil passages and downstream of the throttle and extends along the axis of the camshaft toward the cam piece provided at at least one of two portions of the camshaft on two sides of the camshaft journal corresponding to the branch oil passage in the direction along the axis of the camshaft to supply the lubricant to the cam piece.

2. The lubricant supply mechanism of claim 1, wherein the camshaft further includes, at or near an axial end of the camshaft, a position regulating journal with a larger diameter than the camshaft journals to regulate an axial movement of the camshaft, a branch passage for the position regulating journal branches off from the connection passage for the camshaft to supply the lubricant to a bearing of the position regulating journal rotatably supporting the position regulating journal, and the branch passage for the position regulating journal branches off from the connection passage for the camshaft so as to be located in a position lower than an uppermost portion of the camshaft.

3. The lubricant supply mechanism of claim 2, wherein the branch passage for the position regulating journal branches off from a joint between the connection passage for the camshaft and the internal passage.

4. A lubricant supply mechanism for camshaft journals of an engine including a camshaft, provided in a cylinder head and including the camshaft journals, and bearings, each rotatably supporting one of the camshaft journals of the camshaft, the mechanism comprising:

an oil supply path passing through members separate from and attached to the cylinder head to supply a lubricant discharged from an oil pump in the engine to the bearings, wherein the oil supply path includes an oil supply passage for the camshaft located above the camshaft and extending along an axis of the camshaft, a connection passage for the camshaft located between the oil supply passage for the camshaft and an internal passage in the cylinder head, and supplying the lubricant having passed through the internal passage to the oil supply passage for the camshaft, and branch oil passages for the camshaft journals, each branch oil passage branching off from the oil supply passage for the camshaft, connected to a respective bearing of the bearings from above, and supplying the lubricant to the respective bearing of the bearings, each of the branch oil passages includes a throttle with a smaller cross-sectional flow area than the oil supply passage for the camshaft, the camshaft further includes, at or near an axial end of the camshaft, a position regulating journal with a larger diameter than the camshaft journals to regulate an axial movement of the camshaft, a branch passage for the position regulating journal branches off from the connection passage for the camshaft to supply the lubricant to a bearing of the position regulating journal rotatably supporting the position regulating journal, and the branch passage for the position regulating journal branches off from the connection passage for the camshaft so as to be located in a position lower than an uppermost portion of the camshaft.

5. The lubricant supply mechanism of claim 4, wherein the branch passage for the position regulating journal branches off from a joint between the connection passage for the camshaft and the internal passage.

* * * * *